US006779939B1

(12) United States Patent
Aubut

(10) Patent No.: US 6,779,939 B1
(45) Date of Patent: Aug. 24, 2004

(54) ALBUM PAGE HAVING A REINFORCEMENT AREA

(75) Inventor: Gérald Aubut, Boucherville (CA)

(73) Assignee: Albums df Ltée, Longueuil (CA)

( * ) Notice: Subject to any disclaimer, the term of this patent is extended or adjusted under 35 U.S.C. 154(b) by 66 days.

(21) Appl. No.: 09/906,800

(22) Filed: Jul. 18, 2001

(51) Int. Cl.[7] ..... B42F 13/00
(52) U.S. Cl. ..... 402/79; 281/38
(58) Field of Search ..... 402/4, 79, 80 R, 402/80 L, 80 P; 281/38, 36, 21.1, 15.1

(56) References Cited

U.S. PATENT DOCUMENTS 4,784,508 A * 11/1988 Shannon ..... 402/79
6,012,866 A * 1/2000 Pudosek ..... 402/79
6,019,539 A * 2/2000 Lynton ..... 402/79
6,168,340 B1 * 1/2001 Lehmann et al. ..... 402/79

* cited by examiner

*Primary Examiner*—Willmon Fridie, Jr.
(74) *Attorney, Agent, or Firm*—Goudreau Gage Dubuc

(57) ABSTRACT

An album page for displaying a flat insert such as a photograph. This album page has a generally rectangular configuration and includes an insert-receiving pocket and an album securement portion. The insert-receiving pocket is formed of two sheets disposed in mutually overlying relation and includes at least one open side and at least one sealed side. The album securement portion is contiguous to one side of the pocket and includes at least one aperture, a fold line disposed between the pocket and this securement portion and at least one reinforcement area. The reinforcement area is adjacent to an aperture and is spaced apart from the fold line to define a folding area therebetween and is configured and sized for imparting flexibility to this folding area while substantially avoiding the bending of the flat insert in the pocket when folded. A photo album comprising such album pages is also disclosed.

13 Claims, 3 Drawing Sheets

ALBUM PAGE HAVING A REINFORCEMENT AREA

FIELD OF THE INVENTION

The present invention relates to an album page. More specifically, the present invention is concerned with a photo album page having a photo insert pocket and an album securement portion including a reinforcement area.

BACKGROUND OF THE INVENTION

Album pages for displaying photographs which are in turn retained in a photo album, such as a binder or the like, are well known. Typically, the photograph is inserted in an insert-receiving pocket and the album page is secured to the photo album by way of an album securement portion. The securement portion includes holes for being engaged by binder rings or the like. A fold line, such as seal line or a vertical stitch line, separates the securement portion and the pocket. The holes are spaced apart from the fold line to define a spacing or folding area therebetween on the securement portion. This spacing or folding area is usually made flexible so as to allow the user to easily turn an album page retained in a photo album.

A drawback with many standard album pages is that, when the photo album includes a large quantity of these pages having photos inserted therein, tension is created near the fold line at the folding area or spacing. This rigidity of the securement portion makes it difficult to turn a page without causing the edge of the photograph to bend.

OBJECT OF THE INVENTION

The general object of the present invention is therefore to provide an improved album page.

SUMMARY OF THE INVENTION

More specifically, in accordance with the present invention, there is provided an album page for displaying a flat insert, this album page comprises:

an insert-receiving pocket which is formed of first and second sheets disposed in mutually overlying relation, this insert-receiving pocket includes at least one open side and at least one sealed side and is configured and sized so as to receive the flat insert therein; and an album securement portion which is contiguous to one side of the insert-receiving pocket and includes:

at least one aperture;

a fold line disposed between said insert-receiving pocket and the album securement portion; and at least one reinforcement area formed on the album securement portion adjacent to that at least one aperture and being so spaced from the fold line as to define a folding area therebetween, the reinforcement area is configured and sized for imparting flexibility to the folding area while substantially avoiding bending of the flat insert in the insert-receiving pocket when folded.

In accordance with another aspect of the present invention, there is provided a photo album comprising an album page for displaying photographs, this photo album comprises front and back covers and album page engaging elements therebetween, the album page comprises:

a photograph-receiving pocket which is formed of first and second sheets disposed in mutually overlying relation, the photograph-receiving pocket includes at least one open side and at least one sealed side and is configured and sized so as to receive the photograph therein; and an album securement portion being contiguous to one side of the insert-receiving pocket and including:

at least one aperture;

a fold line disposed between the photograph-receiving pocket and the album securement portion; and at least one reinforcement area formed on the album securement portion adjacent to that at least one aperture and being so spaced from the fold line as to define a folding area therebetween, the reinforcement area is configured and sized for imparting flexibility to the folding area while substantially avoiding bending of the flat insert in the insert-receiving pocket when folded.

Other objects, advantages and features of the present invention will become more apparent upon reading of the following non restrictive description of preferred embodiments thereof, given by way of example only with reference to the accompanying drawings.

BRIEF DESCRIPTION OF THE DRAWINGS

In the appended drawings in which like reference numbers indicate like elements throughout and in which.

DESCRIPTION OF THE PREFERRED EMBODIMENT

With reference to the appended drawings, a preferred embodiment of the present invention will be disclosed herein.

Figure 1:
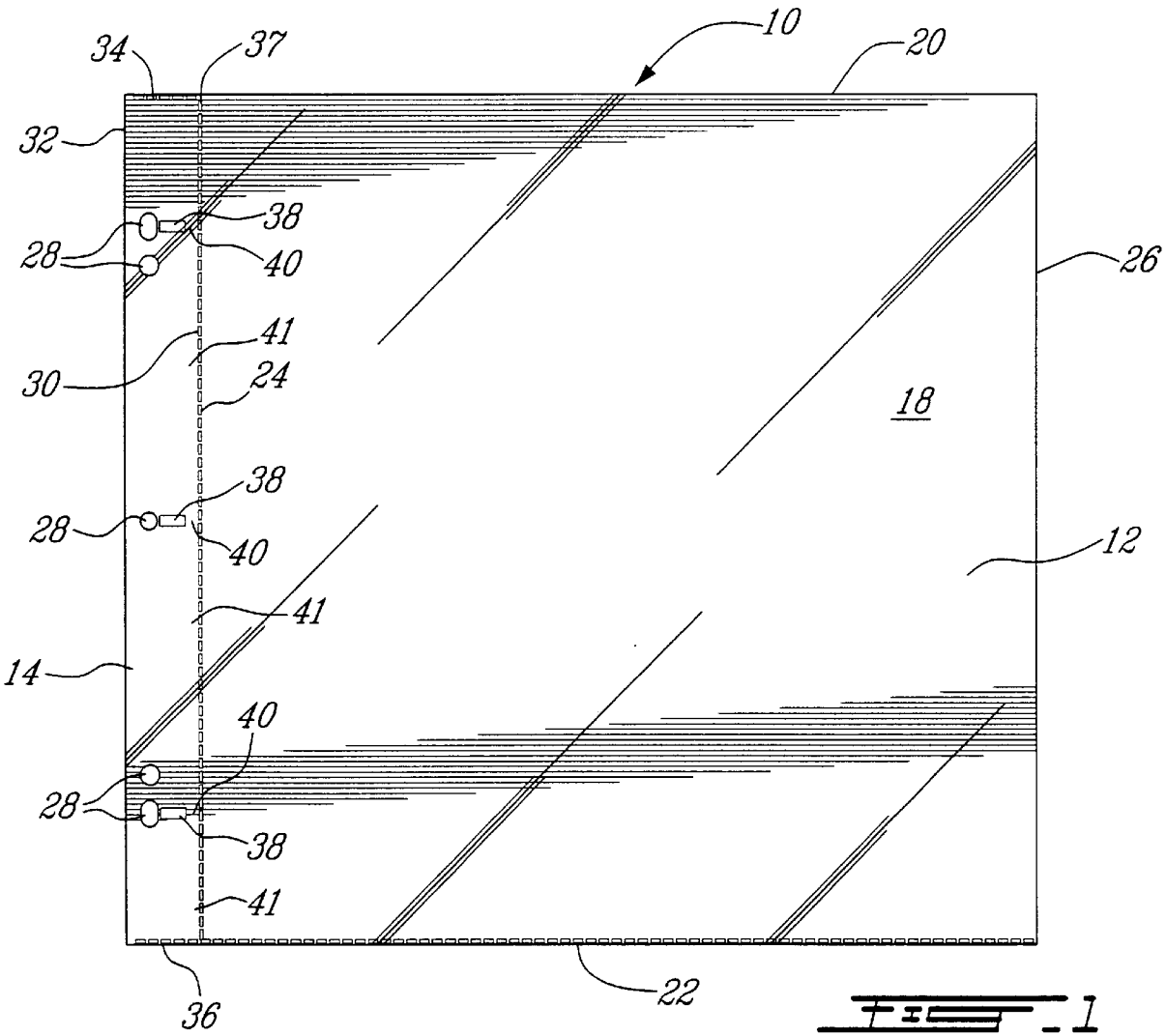
FIG. 1 is a front elevational view of the an album page in accordance with one preferred embodiment of the present invention.

FIG. 1 shows a preferred embodiment of an album page according to the present invention and generally denoted 10, for displaying a flat insert. Preferably, the album page 10 has a generally rectangular configuration. Of course, the album page 10 may have other suitable configurations as is known in the art.

As shown, page 10 includes an insert-receiving pocket 12 and an album securement portion 14.

As will be explained below, the insert receiving pocket 12 is configured for receiving a flat insert therein which is to be displayed.

The insert-receiving pocket 12 is formed of a first sheet 18 and a second sheet (not shown) which are disposed in mutually overlying relation to one another. Preferably, the first and second sheets are similarly configured and sized. Advantageously, the first and second sheets are made from durable transparent plastic sheet material. In this way, a flat insert may be displayed though the first or second sheets. Alternatively, the first sheet 18 may be made from transparent sheet material and the second sheet may be a back panel made of rigid plastic or any other suitable non-transparent material.

It is to be understood that the terms "first" and "second" are used herein throughout only to facilitate the description and hence are interchangeable.

As mentioned above, the insert-receiving pocket 12 is configured and sized to snugly receive therein a flat insert such as a photograph. Obviously, the insert-receiving pocket 12 may receive two photographs, each being displayed through a respective transparent first and second sheet. Other flat inserts having other configurations may also be displayed and hence, insert-receiving pockets 12 having other suitable configurations may also be contemplated within the scope of the present invention.

As shown, pocket 12 is bound by top and bottom sides or edges 20, 22 and furthermore by an album securement portion side 24 and a free side or edge 26. Any one of sides 20, 22, 24 and 26 may constitute an open side for inserting the flat insert in the pocket 12 while the other side or sides is sealed. What is advantageous is that the pocket includes at least one open side and at least one sealed side. This open side may be a cut in the first sheet 18 for example. Preferably, the top side 20 is the open side and sides 22, 24 and 26 are sealed.

The album securement portion 14 is configured for securing the album page 10 to an album or any other like binder or folder. The album securement portion 14 is contiguous to one side of the pocket 12. In this example, the securement portion 14 is contiguous to the album securement side 24.

The album securement portion 14 includes at least one aperture 28; in the example shown herein, there are five such apertures 28. Apertures 28 are configured and sized for receiving the page engaging elements of an album, binder, folder or the like, as will be explained below.

The album securement portion 14 also includes a fold line 30. As shown, the album securement side 24 is contiguous with this fold line 30. The fold line 30 may be a seal line or a vertical stitch line. What is advantageous is that the fold line 30 be interposed between the securement portion 14 and the pocket 12 so as to provide for portion 14 and pocket 12 to be folded about this fold line 30.

The album securement portion 14 includes a side edge 32 opposite to the fold line 30 and is bound by top and bottom sides 34 and 36. Sides 32, 34 and 36 may be open or sealed.

The album securement portion top and bottom sides 32, 34 may be respectively contiguous with the pocket top and bottom sides 20 and 22. It should be noted that, when the pocket top side 20 and the album securement portion top side 32 are open, the aforementioned open contiguity will be interrupted by the top sealed tip 37 of the sealed fold line 24.

Preferably, the album securement portion 14 is made of the same first 18 and second overlying sheets as the pocket 12.

The album securement portion also includes at least one reinforcement area 38 formed thereon and adjacent to an aperture 28. In the example shown, there are three such reinforcement areas 38, each substantially near and adjacent to an aperture 28. Of course, a greater number of reinforcement areas 38 may be contemplated within the scope of the present invention.

The reinforcement area 38 is spaced apart from the fold line 30 so as to define a folding area 40 therebetween. Also shown is a space 41 which corresponds to the full strip of material along the fold line 30 and contiguous therewith and having a width similar to that of the folding area 40. The folding area 40 and space 41 is made of flexible material, such as plastic. As will be explained below, the folding area 40 and space 41 act together to provide the needed flexiblity to the securement portion 14, when turning a page 10 and thereby slightly folding it near the fold line 30.

As will also be explained below, the reinforcement areas 38 are configured for imparting flexibility to the folding area 40.

The reinforcement areas 38 may be integral with the album securement portion 14. In a preferred embodiment, an area 38 may be a deformed area in the securement portion 14, such as heat or seal stamp for example. Alternately, an area 38 may be a patch sealed unto the album securement portion 14. What is advantageous is that these area 38 are somewhat rigid in comparison with the folding area 40.

A reinforcement area 38 may be provided in a variety of suitable configurations. In the present non-limiting example, these areas 38 have a generally rectangular configuration.

Figure 2:
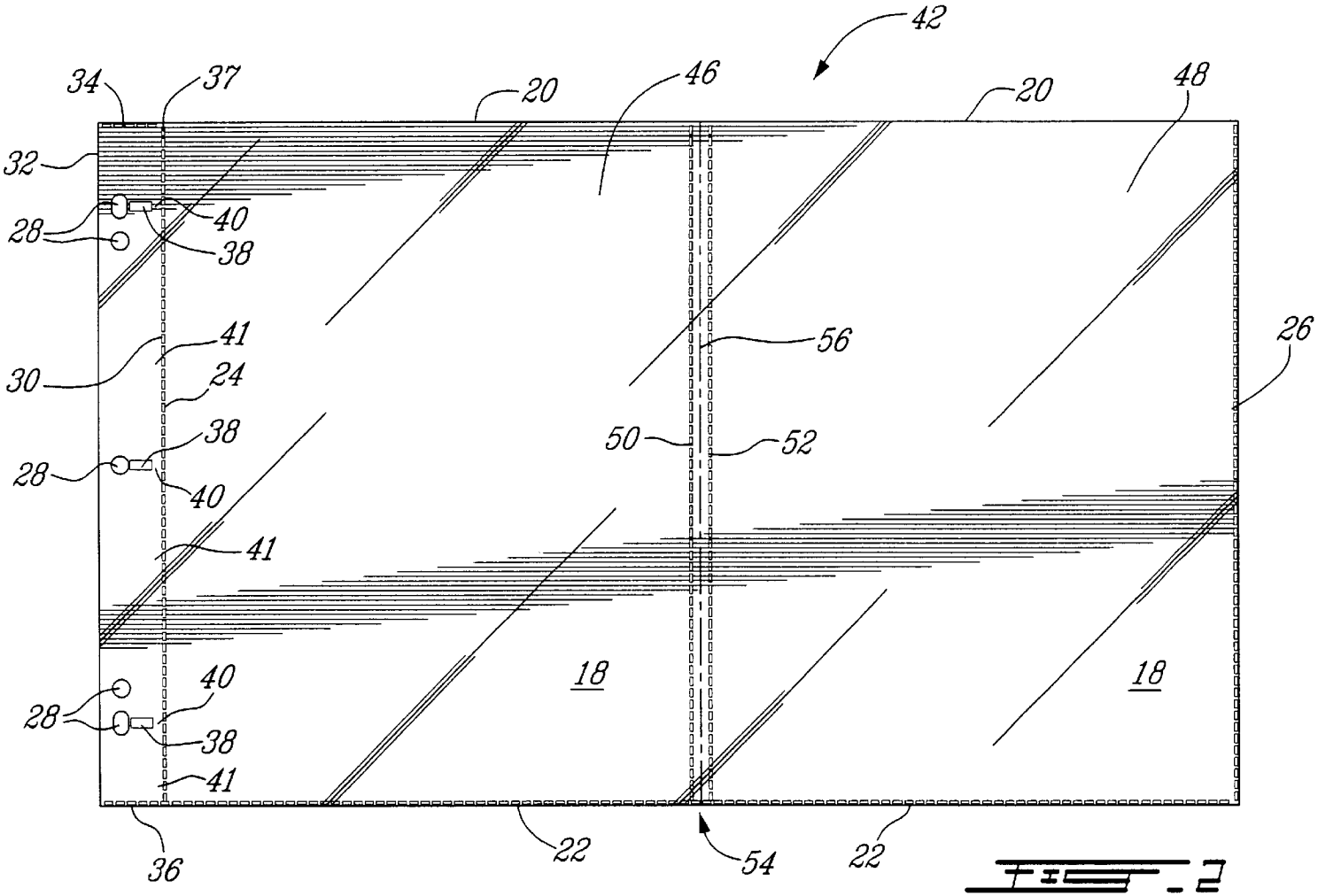
FIG. 2 is a front elevational view of an album page in accordance with another preferred embodiment of the present invention.

Referring now to FIG. 2, there is shown another preferred embodiment of the album page according to the present invention, which is generally denoted 42, for displaying a flat insert. Again, page 42 has a generally rectangular configuration.

Album page 42 includes an insert-receiving pocket portion 44 and an album receiving portion 14.

It should be understood, that the term "pocket" may be construed to mean "pocket portion". It should also be understood that a pocket is a pocket portion if it includes a plurality of pockets.

Therefore, the pocket portion 44 is formed of a first sheet 18 and a second sheet (not shown) which are disposed in mutually overlying relation to one another. The pocket portion 44 is bound by top and bottom sides or edges 20 and 22 respectively and by a lateral album securement portion side 24 and a lateral free side or edge 26.

In the example shown, the pocket portion 44 includes first and second adjacent and similar pockets 46 and 48, each configured to receive therein a respective flat insert, such as a photograph for example. Of course, the pocket portion 44 may be configured to include a greater number of pockets.

Each first and second pocket 46, 48 is bound by the same top and bottom sides 20, 22. The first pocket 46 is bound by the lateral album securement portion side 24 and an opposite lateral side 50. The second pocket 48 is bound by the lateral free side 26 and an opposite lateral side 52. Any of sides 20, 22, 24, 26, 50 and 52 may constitute an open side. Each pocket 46 and 48 includes at least one open side and at least one sealed side. Furthermore, sides 50 and 52 may both be open so as to provide for pockets 46 and 48 to display the same flat insert, such as a landscape or panoramic photograph for example.

Sides 50 and 52 are spaced apart to define an intermediate portion 54 which includes a pocket fold line 56 disposed between pockets 46 and 48 so as to provide for placing either one of pockets 46 and 48 in overlying relation to the other.

As shown, the album securement portion 14 is contiguous to one side 24 of the first pocket 46 and is similarly constructed as the album securment portion 14 described for the album page 10. Again, what is essential to the present invention is that the album securement page 14 of album page 40 includes at least one reinforcement area 38 formed thereon and adjacent to an aperture 28.

Figure 3:
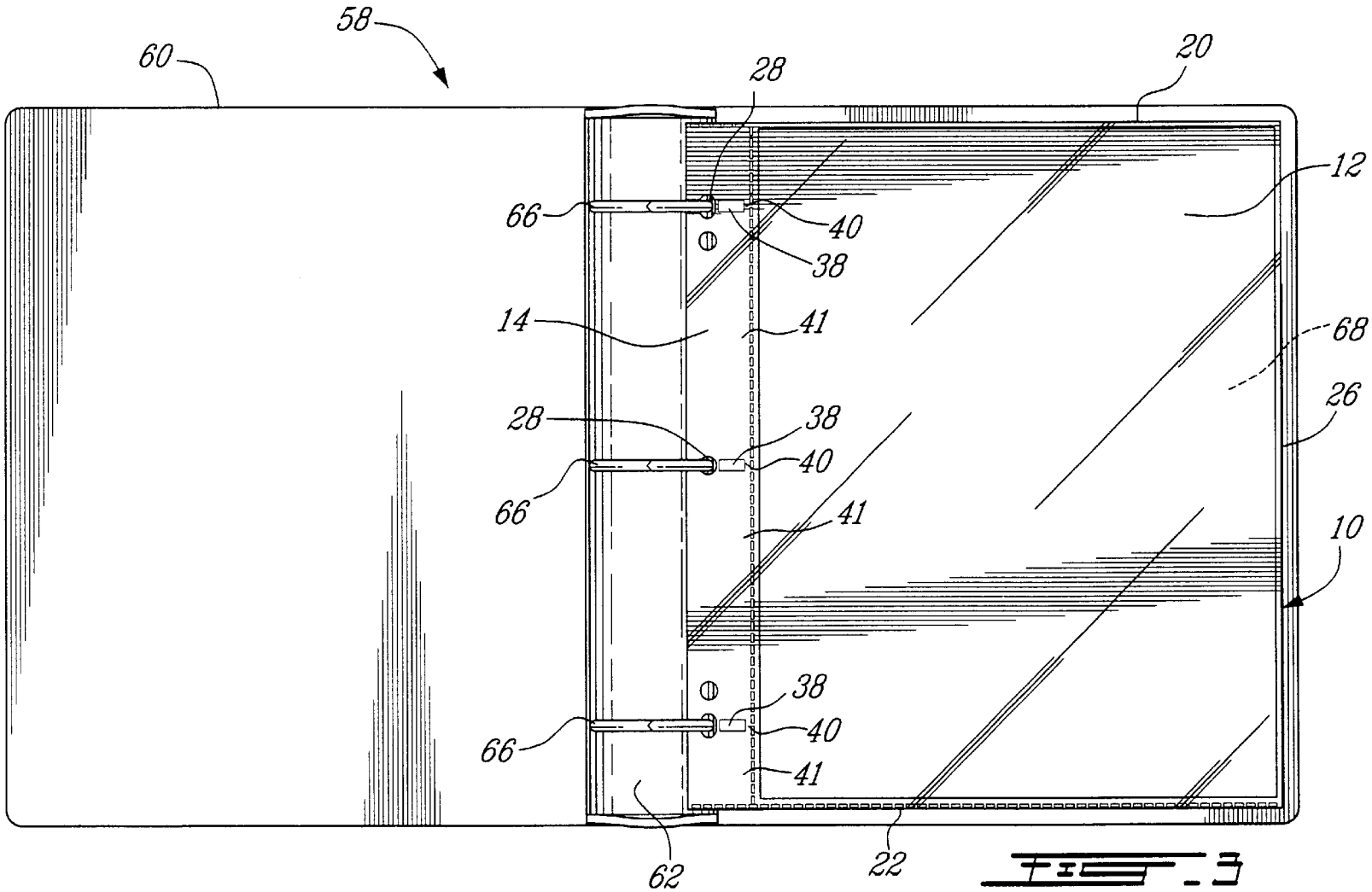
FIG. 3 is a front elevational view of an open photo album including the album page of FIG. 1.

Turning now to FIG. 3, there is shown a photo album 58 including at least one album page in accordance with the present invention, such as album pages 10 or 42. In the example shown, the photo album 58 includes album page 10. It should be understood that the term "album" should be construed to also include a folder, a binder or the like.

As shown, photo album 58 includes front and back covers 60 and 62 and a middle binding portion 62 therebetween.

The album page 10 is secured to the photo album 56 via apertures 28 formed on the album securement portion which are configured to receive album page engaging elements such as rings 66 mounted to portion 62 of album 58. Of course, other ways of securing album 10 page to photo album 58 may be contemplated.

In operation, a photograph 68 is inserted in the photograph-receiving pocket 12, through an open top side 20, for example, so as to be displayed through a transparent first sheet 18. When a plurality of such pages 10 including photographs 68 are secured to the photo album, the user is able to turn each page 10 so as to view a particular photograph 68 without causing the photograph to bend. The foregoing is provided by the reinforcement area 38 which acts as a support for the folding area 40 allowing it to maintain its flexible characteristics.

As mentioned above, in prior art album pages, the space between the apertures and the fold line becomes rigid due to tension. This effectively causes the fold to occur near the apertures rather than near the fold line when turning a page, hence, making it quite difficult to properly turn an album page. This rigidity usually causes the photo in the pocket to bend, since the user has to exert a greater force when turning a page causing the fold to occur on the other side of the fold line about the pocket and hence, damaging the photo therein.

The advantage of the reinforcement areas 38 is that they obviate this drawback by supporting the folding area 40 so that the fold occurs near the fold line 30 at space 41 (which includes the folding area 40). In this way, reinforcement areas 38 impart flexibility to the folding area 40 allowing the user to turn a page while substantially avoiding bending the photograph 68 in pocket 12.

Furthermore, areas 38 also reinforce the area about the aperture 28 allowing the user to easily turn a page 10 about rings 66.

In fact, the reinforcement areas 38 act as a support for the whole securement portion 14, facilitating the overall handling of such pages 10 displaying photos 68 and being retained in an album 58.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

What is claimed is:

1. An album page for displaying a flat insert, said album page comprising:

an insert-receiving pocket being formed of first and second sheets disposed in mutually overlying relation, said insert-receiving pocket including at least one open side and at least one sealed side and being configured and sized so as to receive the flat insert therein; and an album securement portion being contiguous to one side of said insert-receiving pocket and including:

at least one aperture;

a fold line disposed between said insert-receiving pocket and said album securement portion, and at least one reinforcement area selected from the group consisting of a heat stamp and seal patch formed on said album securement portion adjacent to said at least one aperture and being so spaced from said fold line as to define a folding area therebetween, said reinforcement area being configured and sized for imparting flexibility to said folding area while substantially avoiding bending of said flat insert in said insert-receiving pocket when folded.

2. An album page according to claim 1, wherein said at least one reinforcement area is integral to said album securement portion.

3. An album page according to claim 1, wherein said album securement portion is formed of said first and second sheets.

4. An album page according to claim 1, wherein said said fold line is a seal line.

5. An album page according to claim 1 wherein said first and second sheets are made of transparent material.

6. An album page according to claim 1 wherein said first sheet is made of transparent material and said second sheet includes a back panel.

7. An album page according to claim 1, wherein said pocket defines a generally rectangular configuration.

8. An album page according to claim 7 wherein said album securement portion further includes a side edge opposite and substantially parallel to said fold line, said album securement portion being bound by top and bottom edges.

9. An album page for displaying a flat insert, said album page comprising:

an insert-receiving pocket being formed of first and second sheets disposed in mutually overlying relation, said insert-receiving pocket including at least one open side and at least one sealed side and being configured and sized so as to receive the flat insert therein; and an album securement portion being contiguous to one side of said insert-receiving pocket and including:

at least one aperture;

a fold line disposed between said insert-receiving pocket and said album securement portion; and at least one reinforcement area formed on said album securement portion adjacent to said at least one aperture and being so spaced from said fold line as to define a folding area therebetween, said reinforcement area being configured and sized for imparting flexibility to said folding area while substantially avoiding bending of said flat insert in said insert-receiving pocket when folded, wherein said insert-receiving pocket includes first and second pockets, said album page further comprising a pocket fold line disposed between said first and second pockets so as to place either one of said first and second pockets in overlying relation to the other, each of said first and second pockets being configured and sized to receive a respective flat insert therein.

10. An album page according to claim 9 further comprising an opening disposed between said first and second pockets, said first and second pockets being configured and sized to receive the same flat insert.

11. An album page according to claim 9 wherein said album securement is contiguous to one side of said first pocket, said first and second pockets being bound by respective top open sides and respective bottom sealed sides, said second pocket being bound by a sealed side opposite and substantially parallel to said pocket fold line.

12. An album page according to claim 1 wherein the flat insert is a photograph.

13. A photo album comprising an album page for displaying photographs, said photo album comprising front and back covers and album page engaging elements therebetween, said album page comprising:

a photograph-receiving pocket being formed of first and second sheets disposed in mutually overlying relation, said photograph-receiving pocket including at least one open side and at least one sealed side and being configured and sized so as to receive the photograph therein; and an album securement portion being contiguous to one side to the photograph-receiving pocket and including:

at least one aperture for being engaged by the album page engaging elements;

a fold line disposed between said photograph-receiving pocket and said album securement portion; and at least one reinforcement area selected from the group consisting of a heat stamp and a seal patch formed on said album securement portion adjacent to said at least one aperture and being so spaced from said fold line as to define a folding area therebetween, said reinforcement area being configured and seed for imparting flexibility to said folding area while substantially avoiding bending of said flat insert in said insert-receiving pocket when folded.

* * * * *